US005469955A

United States Patent [19]

Van Rumpt

[11] Patent Number: 5,469,955

[45] Date of Patent: Nov. 28, 1995

[54] DEPOSITING APPARATUS FOR LAUNDRY

[75] Inventor: Jacob Van Rumpt, Ad Vught, Netherlands

[73] Assignee: AMKO International B.V., Kerkdriel, Netherlands

[21] Appl. No.: 222,667

[22] Filed: Apr. 4, 1994

[30] Foreign Application Priority Data

Apr. 7, 1993 [NL] Netherlands ..... 9300607

[51] Int. Cl.[6] ..... B65G 17/46

[52] U.S. Cl. ..... 198/689.1; 198/493; 271/197; 38/143

[58] Field of Search ..... 198/493, 471.1, 198/689.1; 271/195, 197, 184, 274, 276; 38/3, 8, 9, 14, 143

[56] References Cited

U.S. PATENT DOCUMENTS

| | | | |
|---|---|---|---|
| 3,168,307 | 2/1965 | Walton et al. | 271/26 |
| 3,414,997 | 12/1968 | Henry | 38/143 |
| 3,430,952 | 3/1969 | Benjamin | 38/143 X |
| 3,729,846 | 5/1973 | Weir | 38/143 |
| 3,772,808 | 11/1973 | Behn | 38/143 |
| 3,854,567 | 12/1974 | Poupin et al. | 198/689.1 X |
| 4,285,507 | 8/1981 | Marinoff | 271/197 X |
| 4,294,540 | 10/1981 | Thettu | 271/197 X |
| 4,480,742 | 11/1984 | Muylle | 198/689.1 |
| 4,609,108 | 9/1986 | Hristozov et al. | 198/493 X |
| 4,642,085 | 2/1987 | Helm | 198/689.1 X |
| 4,651,984 | 3/1987 | Emrich | 198/689.1 X |
| 5,133,542 | 7/1992 | von Kwiatkowski et al. | 271/197 X |
| 5,279,095 | 1/1994 | Muller | 198/689.1 X |

FOREIGN PATENT DOCUMENTS

| | | |
|---|---|---|
| 0345087 | 2/1989 | European Pat. Off. . |
| 2008831 | 5/1969 | France . |

*Primary Examiner*—James R. Bidwell
*Attorney, Agent, or Firm*—DeLio & Peterson

[57] ABSTRACT

A depositing apparatus for depositing a piece of laundry including an endless conveyer belt upon which the laundry is spread and stretched. The conveyer belt can supply the deposited laundry to an apparatus placed downstream of the conveyor belt. The conveyor belt comprises a number of air passage openings, and a suction which is positioned below the upper surface of the conveyor belt. The suction means sucks in air through the upper surface of the conveyor belt in order to suck the piece of laundry against the conveyor belt. The suction comprises at least one chamber-like space having an open upper side and a discharge side. At least two facing sides of the chamber-like space define a venturi.

17 Claims, 3 Drawing Sheets

DEPOSITING APPARATUS FOR LAUNDRY

The invention relates to a depositing apparatus for depositing a piece of laundry, after spreading or stretching thereof, on an endless conveyor belt, which can supply the deposited piece of laundry to an apparatus placed downstream of it.

Such an apparatus is known from applicant's European patent specification 161,716. This document discloses a depositing apparatus, wherein a piece of laundry is fetched by means of a movable collector rod, and is subsequently placed on the conveyor belt by means of a reeling unrolling rod which can move around the collector rod. The piece of laundry is supplied with two corner points, each in a clamp, the piece of laundry being spread or stretched in front of the conveyor belt.

The drawback to this known apparatus is that many moving and driven parts are necessary in order to deposit the laundry. This renders the apparatus complicated and expensive.

It is therefore an object of the invention to provide a depositing apparatus which is more easy to manufacture and thus less expensive.

According to the invention this is achieved with the measures, that the conveyor belt comprises a number of air passage openings, and that suction means are provided below the upper surface of the conveyor belt, for sucking in air through the upper surface of the conveyor belt, to suck the piece of laundry against the conveyor belt, said suction means comprising at least one chamber-like space having an open upper side and a discharge side, at least two facing sides of the chamber-like space defining a venturi.

As a consequence, the supplied and spread-out piece of laundry will be sucked against the conveyor belt, without moving and driven means being required to deposit the piece of laundry.

As a result of the action of the venturi, the suction means will suck the piece of laundry effectively.

The suction means advantageously comprise at least one first blow pipe having openings, which first blow pipe is arranged for cooperation with the venturi.

Because the first blow pipe blows the air through the discharge side of the chamber-like space, air is sucked out of the chamber-like space and the piece of laundry is sucked against the conveyor belt.

It is advantageous to dispose the first blow pipe in or above the narrowing upper portion of the venturi.

Hereby a more effective suction is obtained.

In order to obtain sufficient suction, the sides of the narrowing part of the venturi define an angle of between 20° and 70°, and preferably 40°, with respect to each other, and the sides of the widening part of the venturi define an angle of between 6° and 30°, and preferably 12°, with respect to each other, and the narrowing of the venturi is between 10 and 25 mm, and preferably 15 mm, wide. The preferred values provide the best suction in this embodiment.

In order to obtain a good sucking in of the air, the first blow pipe is disposed centrally between the walls of the upper part of the chamber-like space, at a distance of between 40 mm and 150 mm, and preferably 90 mm, above the narrowing of the venturi, and the openings in the first blow pipe are round and have a diameter of 1 mm, and are arranged at a distance of less than 35 mm, and preferably 18 mm, from each other. The preferred values provide the best sucking action in this embodiment.

By means of the chamber-like space the apparatus forms a wall for collecting loose textile particles and for guiding these particles to the discharge side of the venturi, which defines an open bottom side of the chamber-like space.

As a consequence hereof, the apparatus is self-cleaning and no obstruction of suction means can occur.

Advantageously, holes are provided in one or more walls of the narrowing upper part of the chamber-like space, to allow air to flow gradually into the chamber-like space when switching off the supply of pressurized air, so that the deposited piece of laundry remains flat.

Without these holes, when switching off the supply of pressurized air, air would flow through the open bottom side of the chamber-like space, as a result of which the piece of laundry will bulge above the conveyor belt.

For a good suction, the conveyor belt comprises belt strips which are perforated.

In an advantageous manner, blowing means are provided at the front side of the conveyor belt, above the plane through the upper surface of the conveyor belt, to blow the piece of laundry against the conveyor belt.

Owing to this, the clamps do not have to bring the upper edge of the piece of laundry above the conveyor belt, before they release the piece of laundry, but the piece of laundry may continue to hang in front of the conveyor belt until the blow means blow the edge onto the conveyor belt.

In an embodiment, the blow means comprise at least one second blow pipe having openings.

The second blow pipe is advantageously disposed essentially parallel to the front edge of the conveyor belt, and the openings in the second blow pipe are round and have a diameter of 1 mm and are arranged at a distance of less than 70 mm, and preferably 36.5 mm, from each other. At a distance of more than 70 mm between the holes, folds will be blown into the piece of laundry.

It is advantageous that the apparatus comprises pressure means which press on the conveyor belt downstream of the position of the suction means, to press the piece of laundry against the conveyor belt.

As a result, the suction means do not have to suck continuously and the rear part of a piece of laundry is not blown upwards when the blow means blow the front edge of the next piece of laundry against the conveyor belt.

In an embodiment the pressure means comprise an upwardly and downwardly movable pressure roller, and a support plate is provided at the opposite side of the upper surface of the conveyor belt.

A tensile spring is advantageously provided to let only a portion of the weigth of the pressure roller press on the piece of laundry.

As a result, the pressure roller will be made to roll by the piece of laundry, without the pressure roller causing folds to appear in the piece of laundry.

The invention will be further described by means of a preferred embodiment, such as shown in the accompanying drawings, this embodiment being merely intended to serve as an example.

Figure 4:
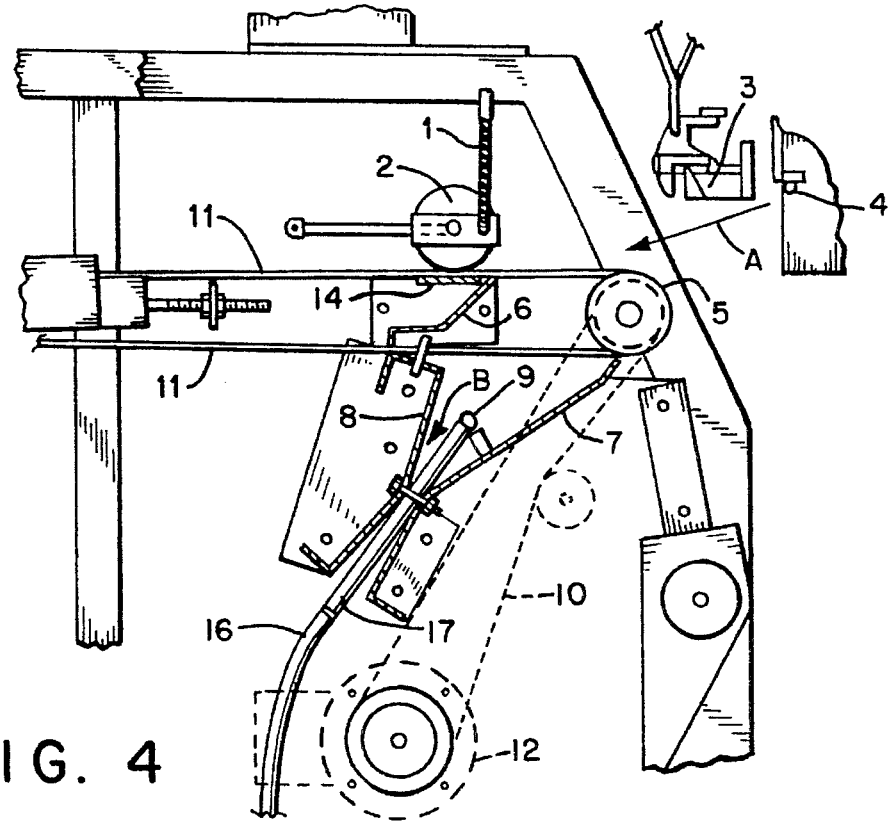
FIG. 4 shows several parts of the depositing apparatus of FIG. 1 in more detail.

The preferred embodiment of the invention may be best described by means of FIG. 4. Herein a conveyor belt 11 is shown, at its front end running around a conveyor roller 5, said conveyor roller being driven by a motor 12 via a drive 10. A venturi housing is disposed below the conveyor belt, said venturi housing extending over the entire breadth of the conveyor belt, of which the walls 6, 7 and 8 define the venturi. So as to suck air through the upper surface of the conveyor belt, the lower surface of the conveyor belts cuts through a side wall of the venturi housing and divides said side wall into an upper part 6 and a bottom part 7. The venturi housing is sealed by the conveyor belt via spring means, not shown.

A first blow pipe 9 is disposed in the upper part of the venturi housing, in which first blow pipe holes have been drilled to blow air downwards through the open bottom side of the venturi housing. A supply pipe 16, 17 supplies compressed air under a pressure of 5 bar to the first blow pipe 9.

The walls of the narrowing part of the venturi housing are arranged under an angle of 40° with respect to each other, and the walls of the widening part of the venturi housing are arranged under an angle of 12° with respect to each other. The narrowing of the venturi housing, extending over the entire length of the venturi housing, has a width of 15 mm. The holes in the first blow pipe 9 have a diameter of 1 mm and a mutual distance of 18 mm. The first blow pipe 9 has an inner diameter of 12 mm and is disposed centrally between the walls of the upper part of the venturi housing, at a distance of about 90 mm above the narrowing of the venturi.

In order not to let the bottom surface of the conveyor belt run through the venturi housing, it is also possible to place an additional conveyor roller under the venturi housing, around which the endless conveyor belt then runs as well.

The conveyor belt consists of a number of belt strips which are perforated so as to obtain a good suction action.

The clamps 3 which supply and spread the piece of laundry are disposed above the upper surface of the conveyor belt, and a second blow pipe 4 is disposed behind these clamps, to blow the upper edge of the piece of laundry onto the conveyor belt by means of a gust of air. This second blow pipe includes a number of holes with a diameter of 1 mm and a mutual distance of 36.5 mm, and also operates with compressed air under a pressure of 5 bar.

A pressure roller 2 is disposed immediately downstream of the venturi housing and presses onto the conveyor belt 11, to keep the piece of laundry pressed against the conveyor belt during further conveyance of the piece of laundry. A support plate 14 has been provided at the bottom side of the upper surface of the conveyor belt to act as a support for the pressure roller. By means of a draw spring 1 it is ensured that the pressure roller does not press on the piece of laundry with its entire weight, so that the piece of laundry will cause the pressure roller to roll without causing folds in the piece of laundry.

Figure 5:
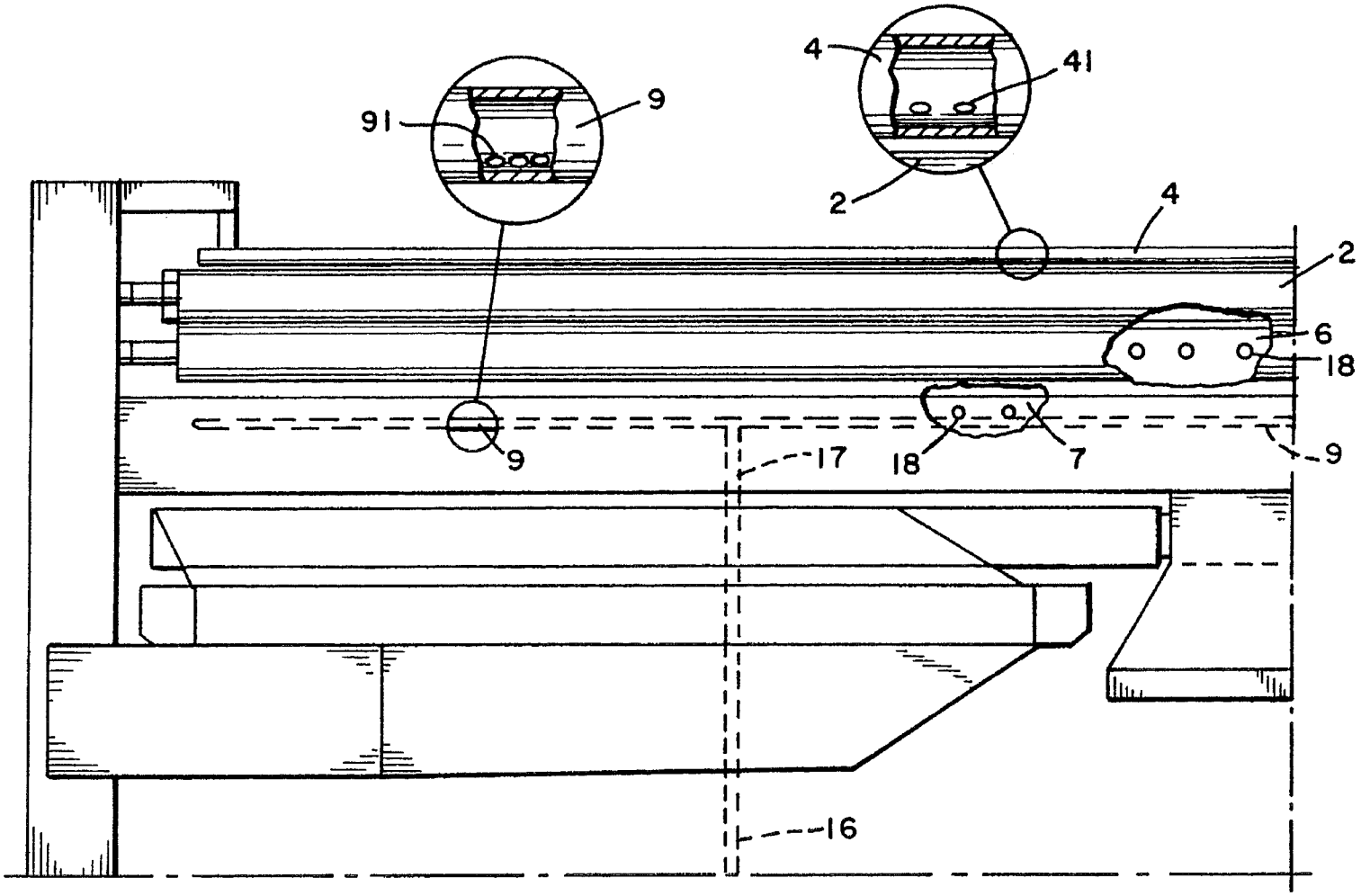
FIG. 5 shows a schematic front view of the apparatus of FIG. 1.

FIG. 5 shows a front view of the first blow pipe in the venturi housing. In FIG. 5 it can also be seen that in the uppermost portion of the walls of the narrowing upper part of the venturi housing holes 18 are provided, to allow air to flow gradually into the venturi housing when the supply of pressurized air is switched off, by which it can be prevented that inflowing air will cause the piece of laundry on the conveyor belt to bulge via the bottom side of the venturi housing. The openings in blowpipe 4 are indicated by reference numeral 41 and those in blowpipe 9 are indicated by reference numeral 91. The openings extend across the entire length of blowpipe 4 and 9.

Figure 1:
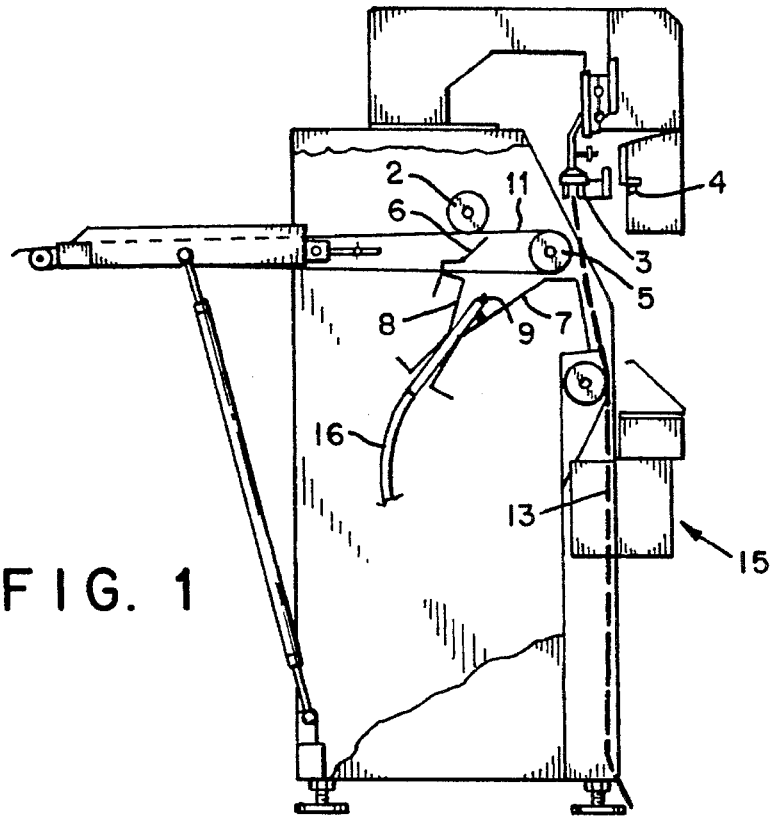
FIG. 1 shows a cross section of the depositing apparatus, in front of which a spread-out piece of laundry is hung.

FIG. 1 shows that a means 15 is provided below the depositing apparatus to spread the piece of laundry over its entire breadth.

The action of the depositing apparatus will now be explained by means of FIGS. 1–3.

FIG. 1 shows that the piece of laundry 13 is supplied to the depositing apparatus by means of the clamps 3. The clamps 3 have spread the upper edge of the piece of laundry. At this moment only the conveyor roller 5 and therefore the conveyor belt 11 is driven.

Figure 2:
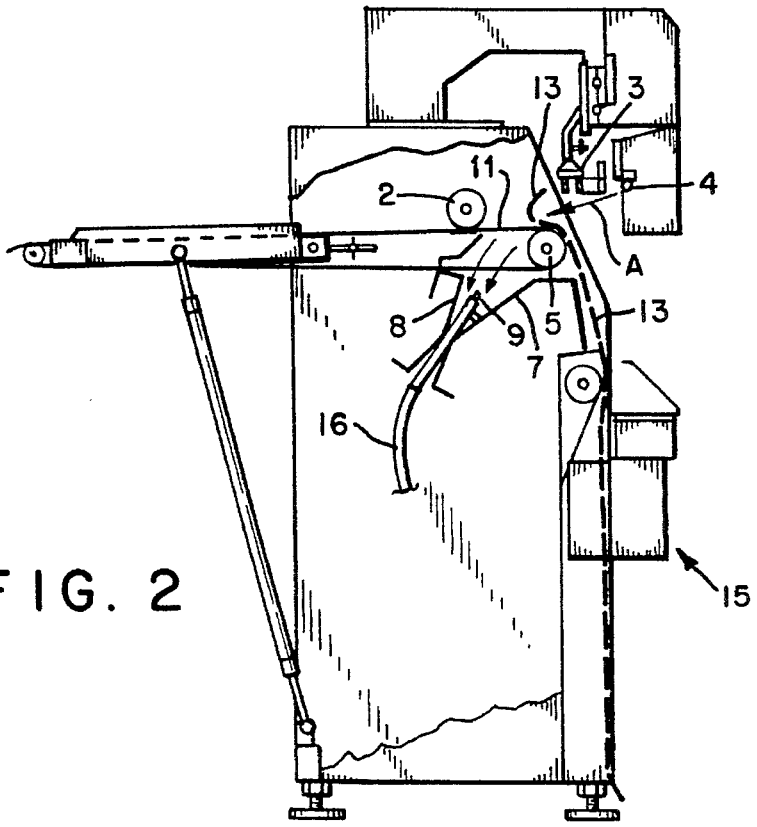
FIG. 2 shows the depositing of the piece of laundry on the apparatus of FIG. 1.

FIG. 2 shows that the second blow pipe 4 then produces a gust of air (arrow A), while simultaneously or shortly after that the clamps 3 release the piece of laundry. At the same time the air pipe 9 starts to blow (arrow B in FIG. 4) so that the venturi housing will commence sucking. The upper edge of the piece of laundry is hereby blown onto the front side of the conveyor belt and simultaneously sucked by the venturi housing. If desired, the second blow pipe 4 produces an additional gust of air in order to blow the upper edge of the piece of laundry correctly, that is to say without being folded, onto the conveyor belt.

Figure 3:
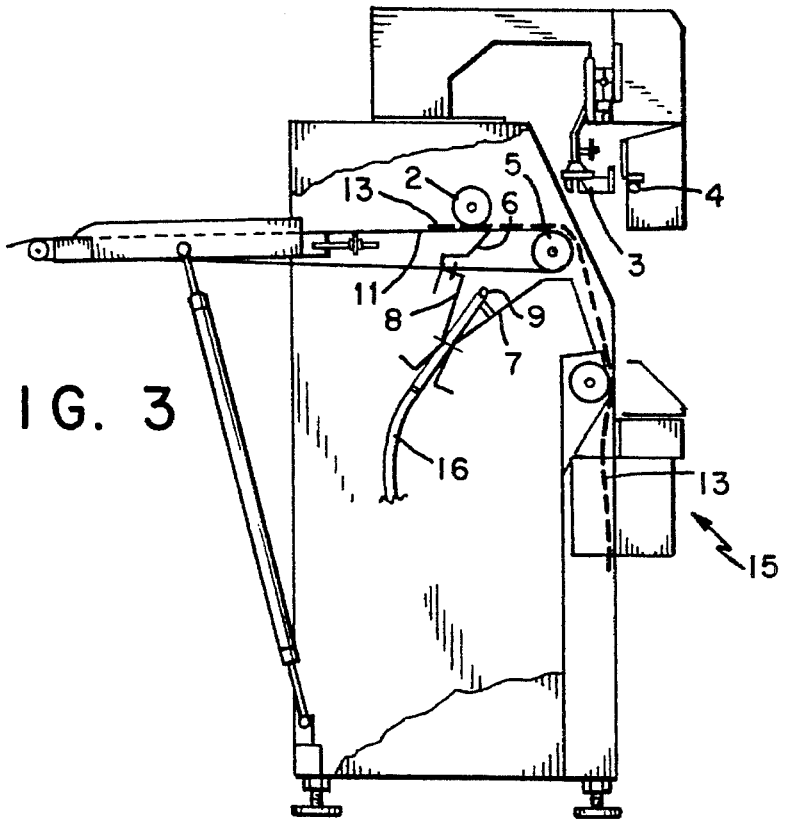
FIG. 3 shows the conveying of the deposited piece of laundry by the apparatus of FIG. 1.

FIG. 3 shows that the conveyor belt has conveyed the upper edge of the piece of laundry under the pressure roller 2. Once the piece of laundry has been conveyed under the pressure roller 2, the stream of pressurized air through the first blow pipe 9 in the venturi housing may be switched off again.

Immediately after a piece of laundry has been passed through by the conveyor belt, a second piece of laundry can be deposited. The pressure roller 2 then also ensures, that the rear part of the first piece of laundry is not lifted and turned up by the gust of air from air pipe 4.

If the apparatus is designed for depositing sheets, the conveyor belt will have a breadth of about 330 cm. After having been deposited, the sheets can then be supplied to for instance a mangling apparatus.

The apparatus can also handle cloths, such as tea-cloths and towels.

I claim:

1. Depositing apparatus for depositing a piece of laundry (13), after spreading or stretching thereof, on an endless conveyor belt (11), which can supply the deposited piece of laundry to an apparatus placed downstream of it, wherein the conveyor belt comprises a number of air passage openings, and suction means are provided below the upper surface of the conveyor belt, for sucking in air through the upper surface of the conveyor belt, to suck the piece of laundry against the conveyor belt, said suction means comprising at least one chamber-like space having an open upper side and a discharge side, at least two facing sides of the chamber-like space defining a venturi.

2. Apparatus according to claim 1, wherein the suction means comprise at least one first blowpipe (9) having openings for blowing air downwards through said discharge side of said venturi.

3. Apparatus according to claim 2, wherein the first blow pipe (9) is disposed in or above the narrowing upper part of the venturi.

4. Apparatus according to claim 3, wherein the sides of the narrowing part of the venturi define an angle of between 20° and 70° with respect to each other, and the sides of the widening part of the venturi define an angle of between 6° and 30° with respect to each other, and the narrowing of the venturi is between 10 and 25 mm wide.

5. Apparatus according to claim 4, wherein the sides of the narrowing part of the venturi define an angle of 40° with respect to each other, and the sides of the widening part of the venturi define an angle of 12° with respect to each other, and the narrowing of the venturi is 15 mm wide.

6. Apparatus according to claim 4, wherein the first blow pipe (9) is disposed centrally between the walls of the upper part of the chamber-like space, at a distance of between 40 mm and 150 mm above the narrowing of the venturi, and the openings in the first blow pipe (9) are round and have a diameter of 1 mm, and are arranged at a distance of less than 35 mm from each other.

7. Apparatus according to claim 6, wherein the first blow pipe (9) is disposed centrally between the walls of the upper part of the chamber-like space, at a distance of 90 mm above the narrowing of the venturi, and the openings in the first blow pipe (9) are arranged at a distance of 18 mm from each other.

8. Apparatus according to claim 1, wherein the chamber-like space forms a wall for collecting loose textile particles and for guiding these particles to the discharge side of the venturi, which defines an open bottom side of the chamber-like space.

9. Apparatus according to claim 2, wherein holes (18) are provided in at least one wall of the narrowing upper part of the chamber-like space, to allow air to flow gradually into the chamber-like space when switching off the supply of pressurized air, so that the deposited piece of laundry remains flat.

10. Apparatus according to claim 1, wherein the conveyor belt comprises belt strips which are perforated.

11. Apparatus according to claim 1, wherein blowing means are provided at the front side of the conveyor belt, above the plane through the upper surface of the conveyor belt, to blow the piece of laundry against the conveyor belt.

12. Apparatus according to claim 11, wherein the blowing means comprise at least one second blow pipe (4) having openings.

13. Apparatus according to claim 12, wherein the second blow pipe (4) is disposed essentially parallel to the front edge of the conveyor belt, and the openings in the second blow pipe (4) are round and have a diameter of 1 mm and are arranged at a distance of less than 70 mm from each other.

14. Apparatus according to claim 13, wherein the openings in the second blow pipe (4) are arranged at a distance of 36.5 mm from each other.

15. Apparatus according to claim 1, wherein the apparatus comprises pressing means which press on the conveyor belt (11) downstream of the position of the suction means, to press the piece of laundry against the conveyor belt.

16. Apparatus according to claim 15, wherein the pressing means comprise an upwardly and downwardly movable pressure roller (2), and a support plate (14) is provided at the opposite side of the upper surface of the conveyor belt (11).

17. Apparatus according to claim 16, wherein a tensile spring (1) is provided to let only a portion of the weight of the pressure roller (2) press on the piece of laundry.

* * * * *